United States Patent [19]

Hagmann et al.

[11] 4,163,316

[45] Aug. 7, 1979

[54] SAFETY RAZOR

[75] Inventors: Peter Hagmann, Langendorf; Ernst Müller, Bibern, both of Switzerland

[73] Assignee: Morris AG, Switzerland

[21] Appl. No.: 870,091

[22] Filed: Jan. 17, 1978

[30] Foreign Application Priority Data

Jan. 17, 1977 [CH] Switzerland ..... 546/77

[51] Int. Cl.[2] ..... B26B 21/06

[52] U.S. Cl. ..... 30/47; 30/87

[58] Field of Search ..... 30/47, 87, 89, 74.1, 30/75

[56] References Cited

U.S. PATENT DOCUMENTS

| | | | |
|---|---|---|---|
| 1,450,604 | 4/1923 | Mossberg | 30/89 |
| 2,755,549 | 7/1956 | Hulkenberg | 30/87 X |
| 3,317,995 | 5/1967 | Bord | 30/87 |

*Primary Examiner*—Jimmy C. Peters

*Attorney, Agent, or Firm*—Holman & Stern

[57] ABSTRACT

A safety razor intended to be discarded after use, comprising a cutting head and a handle. The cutting head includes two oppositely disposed longitudinal surfaces with cutting edges disposed thereon. In order that both cutting edges may be used, the cutting head is rotatably disposed in an extension piece adjoining the handle.

1 Claim, 6 Drawing Figures

SAFETY RAZOR

This invention relates to a safety razor of the type comprising a cutting head, a handle, and an angled extension piece adjoining the handle.

Disposable safety razors are known which consists of a handle and of a cutting head connected to the handle. However, these safety razors have a cutting edge on only one longitudinal surface of the cutting head.

It is an object of this invention to provide a safety razor intended to be discarded after use but having a longer useful life than safety razors of known designs.

To this end, in the safety razor according to the present invention, the cutting head includes at least one cutting edge disposed on each of two oppositely disposed longitudinal surfaces and is adapted to be selectively rotated with respect to the extension piece into either of two operating positions separated from one another by 180°.

In one preferred embodiment of the invention, a recess is provided at one end of the extension piece for the insertion of a cutting-head holder having two parallel outer surfaces, either the extension piece or the cutting-head holder or both being made of a resilient material, the inner surfaces of the recess forming a snap connection with the outer surfaces of the cutting-head holder, and an inwardly projecting collar of the extension piece engaging an annular groove of the cuttinghead holder when the latter is inserted in the recess.

Two preferred embodiments of the invention will now be described in detail with reference to the accompanying drawings, in which.

Figure 1:
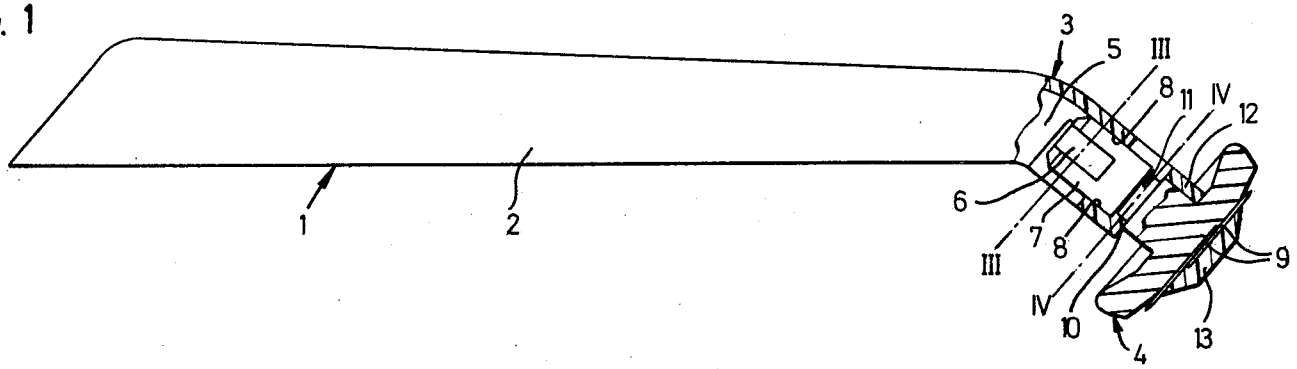
FIG. 1 is a longitudinal section through a first embodiment of a safety razor.
Figure 2:
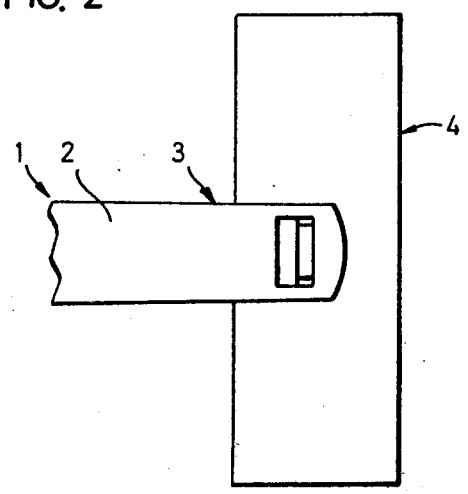
FIG. 2 is a top plan view of a safety razor.
Figure 5:
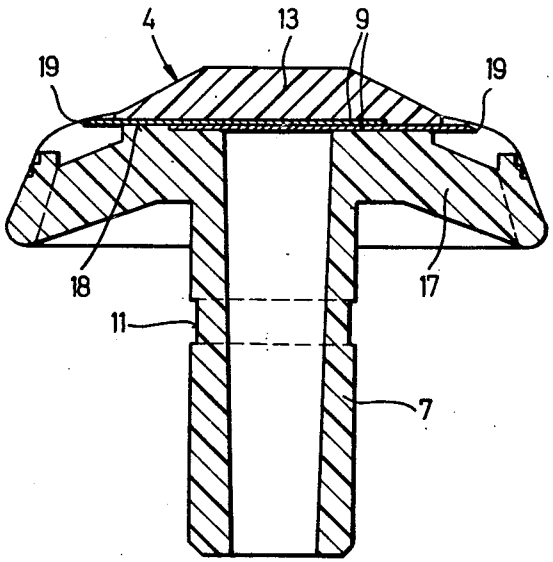
FIG. 5 is a cross-section through the cutting-head of FIG. 1 on a larger scale.

FIGS. 1 and 2 show a safety razor 1 comprising a handle 2, an angled extension piece 3, and a cutting head 4. FIG. 5 shows top support surfaces 18 of the cutting head 4 upon which two partially overlapping razor blades 9 are preferably disposed. A cutting edge 19 of each blade 9 projects beyond the longitudinal surface of the cutting head 4. Pins (not shown) projecting perpendicularly above the support surfaces 18 are fixed in a jutting portion 17. The razor blades 9 are laid over these pins which fit through holes in the blades. Corresponding bores into which the pins project are provided in a cover 13. After the blades 9 have been laid in place, the cover 13 with the bores therein is fitted over the pins, pressed against the portion 17, and secured thereto by means of an ultrasonic welder. Since commercially available razor blades are too wide for the safety razor 1, such blades are preferably halved lengthwise and the halves laid one on top of the other. It would also be possible, however, to use a narrow blade having cutting edges on each of its long sides.

Figure 3:
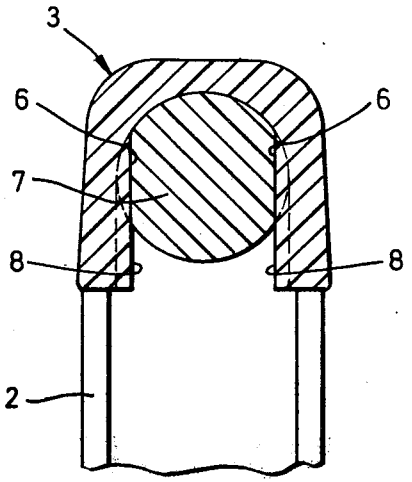
FIG. 3 is a cross-section taken on the line III—III of FIG. 1.

In order that both cutting edges may be used, the cutting head 4 must be rotatable by 180° in the extension piece 3. A cutting-head holder 7 is provided with two parallel outer surfaces 6 as shown in FIG. 3. The angled extension piece 3 is provided with parallel inner surfaces 8 so that the holder 7, and hence the cutting-head 4, may be selectively rotated with respect to the extension piece 3 into either of two positions separated from one another by 180°. To prevent the cutting head 4 from being axially displaced, the extension piece 3 is provided with a collar 10 which engages a groove 11 in the holder 7. At least one of the two parts 3 and 7 must be made of a resilient material or designed to be springy. The safety razor 1 is preferably made of synthetic material. The extension piece 3 is partially provided with apertures in order to facilitate production by injection molding.

Figure 4:
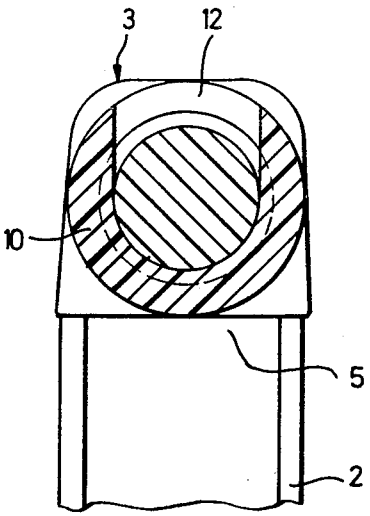
FIG. 4 is a cross-section taken on the line IV—IV of FIG. 1.

FIG. 4 is a cross-section through the extension piece 3 along the collar 10. The recess 5 is intended for the insertion of the cutting-head holder 7 provided with the two parallel outer surfaces 6. The projecting portion 12 of the extension piece 3 extends up to the jutting portion 17 of the cutting head 4.

Figure 6:
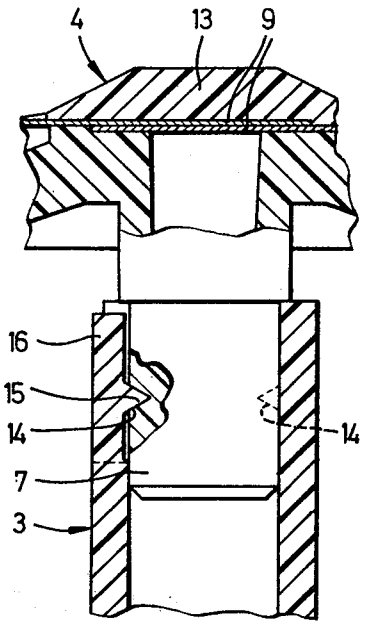
FIG. 6 is a partial cross-section analogous to FIG. 5 in a second embodiment of the invention.

A further embodiment is illustrated in FIG. 6. Here the cutting head 4 is not rotated in the extension piece 3 but taken out, turned by 180°, and reinserted in the extension piece 3. In addition, the cutting-head holder 7 is provided with two notches 14. The extension piece 3 includes two studs 15 which engage the notches 14. Thus, the cutting head 4 is secured against both radial twisting and axial displacement. A portion 16 of the extension piece 3 is designed to be springy so that the cutting head 4 can be pulled out and, after being turned by 180°, reinserted.

In order to increase the cutting action of the safety razor, it would also be possible to dispose an additional blade above or beneath those already provided.

The disposable safety razors described above possess the advantage that their useful life is doubled as compared with prior art designs, without any substantial increase in manufacturing costs.

I claim:

1. A safety razor comprising a cutting head having two oppositely disposed longitudinal surfaces and at least one cutting edge on each of said surfaces, a cutting head holder joining said cutting head, a handle, an angled extension piece joining said handle and including a recess formed at one end of said extension piece receiving said holder, cooperating means on said holder and within said recess for securing said holder against axial displacement relative to said extension piece, said holder having two parallel outer surfaces and said recess having complementary parallel surfaces which engage said outer surfaces of said holder to locate said holder circumferentially in said recess in one of two operating positions separated by 180°, and at least one of said holder and said extension piece being made of resilient material whereby said holder can be rotated in said recess between said operating positions.

* * * * *